US005512009A

United States Patent [19]

Earl

[11] Patent Number: 5,512,009

[45] Date of Patent: Apr. 30, 1996

[54] METHOD AND APPARATUS FOR ATTENUATING OPTICAL CHATTER MARKS ON A FINISHED SURFACE

[75] Inventor: Douglas E. Earl, St. Paul, Minn.

[73] Assignee: Minnesota Mining and Manufacturing Company, Saint Paul, Minn.

[21] Appl. No.: 204,006

[22] Filed: Mar. 1, 1994

[51] Int. Cl.[6] ..... B24B 21/00

[52] U.S. Cl. ..... 451/300; 451/299; 74/55

[58] Field of Search ..... 451/299, 302, 451/304, 121; 74/55, 56

[56] References Cited

U.S. PATENT DOCUMENTS

| | | | |
|---|---|---|---|
| 1,849,868 | 3/1932 | Einstein | 451/121 |
| 1,959,103 | 5/1932 | Le Tarte | 451/121 |
| 2,926,465 | 3/1960 | Sommers | 451/304 |
| 3,452,673 | 11/1966 | Gegenheimer et al. | 74/56 |

FOREIGN PATENT DOCUMENTS

| | | | |
|---|---|---|---|
| 71042969 | 9/1968 | Japan | B21D 0/00 |
| 60044103 | 8/1983 | Japan | B21B 1/22 |
| 49309 | 9/1993 | Russian Federation . | |

OTHER PUBLICATIONS

Article entitled "Identification of chatter sources in cold rolling mills", Nessler et al.; *Iron and Steel Engineer,* Jan. 1993, pp. 40–45.

Article entitled "Analysis of chatter vibration phenomena of rolling mills using finite element methods", Guo et al.; *Iron and Steel Engineer,* Jan. 1993, pp. 29–39.

*The Grinding Wheel,* A Textbook of Modern Grinding Practice, Lewis et al.; 1976, pp. 436–444.

*Primary Examiner*—Bruce M. Kisliuk
*Assistant Examiner*—Andrew Weinberg
*Attorney, Agent, or Firm*—Gary L. Griswold; Walter N. Kirn; James J. Trussell

[57] ABSTRACT

A method and apparatus is provided for reducing optical chatter for use with a machine that is adapted to perform an operation on a surface of a workpiece by bringing a rotating roller into contact with the surface as the workpiece is advanced past the roller. The roller of the machine has a central axis and is powered to rotate about the central axis. The apparatus comprises an oscillation inducing device that is operably coupled to the roller for inducing an axial oscillation in the roller. The frequency of the induced oscillation of the roller is substantially greater than the frequency of rotation of the roller. The method for reducing optical chatter comprises the step of imparting axial oscillations to the roller during rotation of the roller, the imparted oscillations being of substantially greater frequency than the frequency of rotation of the roller.

16 Claims, 5 Drawing Sheets

Axial Roller Displacement (mm)
.038
-.038
0
0.5
1
1.5
2
Number of roller rotations Scratch Departure from Reference Line (mm)
.038
-.038
0
0.5
1.0
1.5
2.0
19
38
57
76
Number of roller rotations
Distance along sample (mm)

19
38
57
76
Distance along sample (mm)

METHOD AND APPARATUS FOR ATTENUATING OPTICAL CHATTER MARKS ON A FINISHED SURFACE

TECHNICAL FIELD

The present invention relates to finishing a surface of a metal workpiece. More particularly, it relates to a method and apparatus for attenuating optical chatter marks that are caused by a rotating tool bearing on the surface of the workpiece.

BACKGROUND OF THE INVENTION

Sheet materials, and in particular metal sheet materials, are often processed by machines that apply pressure to the sheets to reduce their thickness, or apply an abrasive surface to the sheets to provide a desired surface finish thereon. For example, the rolling mill illustrated in FIG. 1 may be used to transform a thick sheet into a thin sheet through the application of pressure by opposed rollers. The surface finishing machine illustrated in FIG. 2 may be used to apply a rotating abrasive surface to a sheet to provide a refined surface finish, for example. Although reduction rolling (as described with reference to FIG. 1) and abrasive finishing (as described with reference to FIG. 2) are distinct processes, the workpieces that emerge from either process often exhibit a similar defect known as "optical chatter".

Optical chatter is defined as a pattern of visible, alternating dark and light bands on the surface of the workpiece. The spacing of the bands is usually linked to the speed of one of the rotating elements of the apparatus, and to the feed rate of the workpiece through the apparatus. Optical chatter is distinguishable from "physical chatter" in that physical chatter represents a measurable variation in the size of the workpiece, whereas optical chatter is a visible defect with surface characteristics that are difficult or impossible to measure accurately. Physical chatter has typically been remedied by refining machine components to obtain perfectly round rollers, bearings with extremely small tolerances, and the like. Optical chatter, however, has not been adequately remedied. In fact, optical chatter may even occur in workpieces finished on machines exhibiting no detectable departures from optimum machine performance, and neither physical, optical, nor chemical analysis of the workpiece has adequately explained the cause of optical chatter. Thus, even well designed and engineered finishing machines can produce optical chatter marks on a workpiece.

The generally accepted explanation for optical chatter is that it is caused by oscillatory movement of the roller away from and toward (i.e. in a plane generally perpendicular to) the workpiece that is being finished. See, for example, Identification of Chatter Sources in Cold Rolling Mills, Gerald L. Nessler et. al., *Iron and Steel Engineer,* January, 1993, and Analysis of Chatter Vibration Phenomena of Rolling Mills Using Finite Element Analysis, Remn-Min Guo et. al. , *Iron and Steel Engineer,* January, 1993. Thus, when the workpiece is fed into a machine in a horizontal plane, as shown in FIGS. 1 and 2, the oscillatory roller movement that causes the optical chatter is thought to be in the vertical plane. This is described herein as "vertical roller oscillation." Vertical roller oscillation is thought to have been caused by radial forces produced by either roller imbalance, or out-of-roundness of the abrasive roller or the back-up roller.

To provide a better understanding of typical processes that may produce workpieces exhibiting optical chatter marks, reference is made to FIGS. 1 and 2. In FIG. 1, rolling mill 20 is used to reduce the thickness of a workpiece (such as a metal sheet) to a predetermined thickness, and includes a powered roller 24 and a backup roller 26. The powered roller 24 includes a roller cage 28 that supports a plurality of working rollers 30, which are free to rotate within the roller cage 28. The powered roller 24 is rotated about central axis 34 in the direction indicated by arrow 32.

The backup roller 26 is adjacent to and spaced from the powered roller 24, and the spacing is less than the initial thickness of the workpiece. The backup roller 26 includes a roller cage 28 that supports a plurality of working rollers 30. The working rollers 30 rotate in the directions indicated by arrows 40 and 42. The backup roller 26 rotates about central axis 38, as indicated by arrow 36, such that the respective peripheral surfaces of the powered roller and the backup roller propel workpiece 22 in direction D.

In operation, workpiece 22 is fed into mill 20 between the powered roller 24 and the backup roller 26 from the left and emerges with reduced thickness to the right. Because the space between the rollers is less than the thickness of the workpiece, the rollers compress the workpiece and the workpiece undergoes plastic deformation with a resultant reduction in thickness. Workpiece 22 remains in rolling contact with powered roller 24 and backup roller 26 as it passes through mill 20, with an insignificant amount of relative motion, or slippage, in the areas of mutual contact. An effect of the plastic deformation of the workpiece 22 is to emboss any surface defects present in either the powered roller 24 or the backup roller 26 onto the surface of the workpiece 22. Thus, the surfaces of the rollers are typically very smooth, and are often finished with a grinding apparatus that imparts a very fine finish to the surfaces of rollers. However, even when smooth rollers are used, optical chatter marks may still be present, which was thought to be a product of vertical roller oscillation by rollers 24 or 26 or both, as described above.

FIG. 2 illustrates a surface finishing machine 40 that imparts a surface finish to a workpiece 42. Workpiece 42 may be a single sheet, as depicted, or a continuous coil of material, for example. A powered roller 44 is rotationally driven about central axis 50 to rotate an abrasive belt 46 in the direction indicated by arrow 48. Generally, the rotation direction is described as being either "against the feed" or "with the feed." Arrow 48 depicts "with the feed" rotation, although the rotational direction of the rollers could be reversed to provide "against the feed" rotation, if desired. An idler roller 52 is spaced from the powered roller 44 to maintains tension in abrasive belt 46. In an alternative embodiment, an abrasive may be provided on the exterior surface of the powered roller 44, which would eliminate the need for the abrasive belt 46 and the idler roller 52.

Workpiece 42 is fed at a controlled rate into surface finishing machine 40. The feed rate is controlled by a feed mechanism 54, which includes a powered feed roller 56, an idler feed roller 58, and a belt 60. Powered feed roller 56 is rotationally driven to drive belt 60 as indicated by arrow 64, and maintains tension in belt 60. Belt 60 has an exterior surface that frictionally engages workpiece 42, to prevent workpiece 42 from slipping with respect to belt 60. A backup roller 66 is disposed beneath belt 60 and proximate the lower radius of powered roller 44, to provide a compressive surface that holds the workpiece 42 in contact with powered roller 44.

The feed rate of workpiece 42 into surface finishing machine 40 is less than the surface speed of powered roller 44, such that there is relative motion (and a corresponding abrasive action) between the workpiece and abrasive belt 46. The abrasive media thus provides a surface finish on the workpiece 42, consisting of a large number of parallel scratches. Optical chatter marks are also produced by apparatuses such as the illustrated surface finishing machine, and it is believed that such optical chatter marks are produced by vertical roller oscillation of roller 44, roller 66, or both, as described above.

Because optical chatter is a visual surface condition that does not affect the structural integrity of most workpieces (sheet metal, for example), it has not in the past been perceived as a defect that required a great deal of attention. However, the demand for finished metal sheets for larger, visually important applications is growing. For example, large metal sheets might be used to adorn the exterior of a building. In such an application, optical chatter would be evident, and would greatly detract from the overall appearance of the building.

Accordingly, it would be a decided advantage to be able to apply a rollered finish to a metal workpiece economically, without also providing optical chatter marks that detract from the appearance of the workpiece.

SUMMARY OF THE INVENTION

The present invention includes within its scope an optical chatter reducing apparatus for use with a machine adapted to finish a surface of a workpiece by applying an abrasive media to the surface with a roller as the workpiece is advanced past the roller. The roller has a central axis and is powered to rotate about that axis. The apparatus comprises an oscillation inducing apparatus operably coupled to the roller for inducing axial oscillations in the roller relative to the surface of the workpiece. The frequency of the induced oscillations is greater than the frequency of rotation of the roller. In one embodiment, the apparatus further comprises cam means for inducing axial oscillations in the roller. The cam means includes a circular face disposed concentric with the central axis of the roller and oriented transverse thereto, a cam race defining a circular cammed surface on the face and concentric with the central axis of the roller, a cam driver means in rotational contact with the cam race means for riding over the cammed surface during the rotation of the roller, and a plurality of cam lobes formed in the surface of the cam race for inducing a plurality of axial oscillations in the roller during each rotation of the roller.

Also provided in accordance with the present invention is an apparatus as described above, in combination with a finishing machine having a roller for applying an abrasive media to a workpiece to be finished, the roller being powered and rotating about a central axis. The apparatus comprises oscillation means operably coupled to the roller for imparting axial oscillations to the roller relative to the workpiece during rotation of the roller, the oscillations being of sufficiently greater frequency than the frequency of rotation of the roller to mask the optical chatter marks.

In another aspect of the present invention, a method is provided for reducing optical chatter marks on a surface of a workpiece. The method comprises the step of imparting axial oscillations to a roller during rotation of the roller, the oscillations being of greater frequency than the frequency of rotation of the roller.

BRIEF DESCRIPTION OF THE DRAWINGS

The present invention is further described with reference to the following Figures, in which like structure is represented by like reference numbers throughout the several views, and wherein.

DETAILED DESCRIPTION OF THE INVENTION

Figure 1:
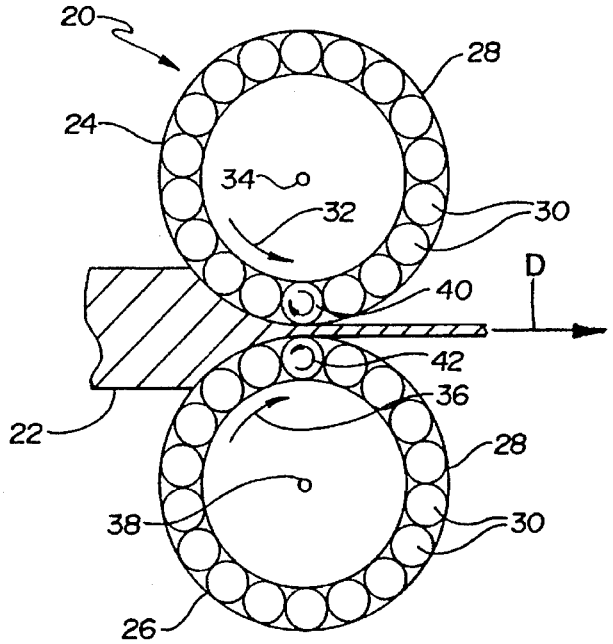
FIG. 1 is a perspective view of a rolling mill acting upon a workpiece.
Figure 2:
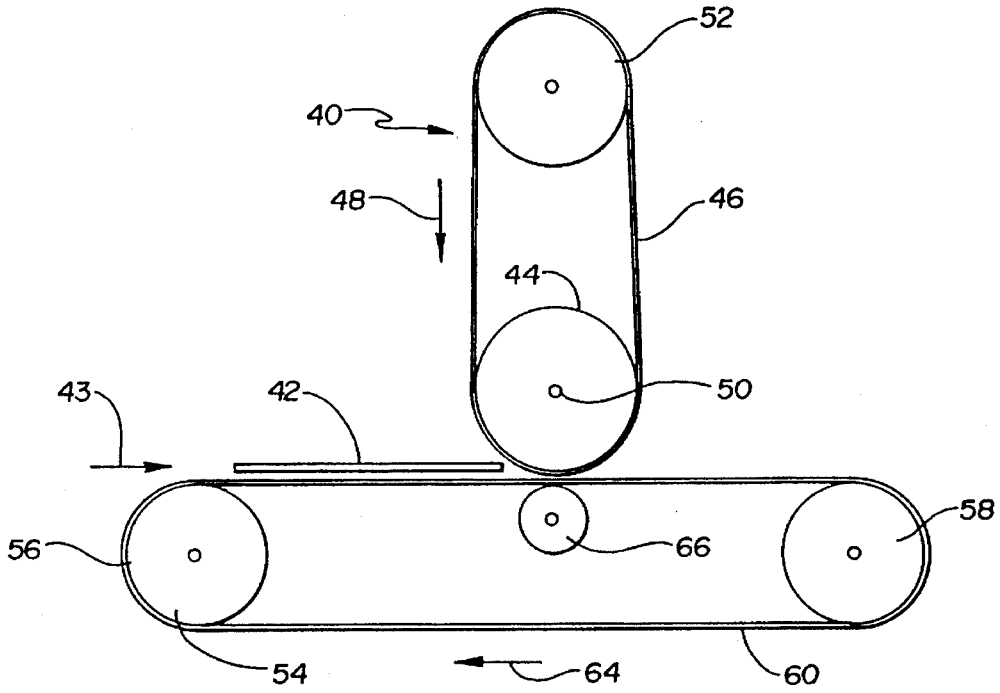
FIG. 2 is a perspective view of a surface finishing machine acting upon a workpiece.

In contrast to the generally accepted explanation for optical chatter (vertical roller oscillation), the present inventors have determined that optical chatter results from heretofore unrecognized axial roller oscillations that produce a cyclical pattern of scratches in the finished surface. The cyclic pattern results from the superposition of two distinct motions of an abrasive roller against the part being finished. The first motion is the linear motion of the roller surface produced by rotation of the roller about its longitudinal axis. This motion is orthogonal to the longitudinal axis of the roller, in the plane of the workpiece, and tangential to the roller surface. Taken individually, the topographical result of this motion would be to produce straight line scratches in the direction in which the workpiece is fed through the finishing machine (the feed direction). The second motion is an axial oscillation of the roller along the longitudinal axis of the roller (i.e. parallel to the axis of rotation). Taken individually, the topographical result of this motion would be to produce scratches that are perpendicular to the feed direction.

In abrasive finishing operations, the two motions described above are combined with, or superimposed upon, each other. Thus, the overall scratch pattern is a combination of the two individual scratch patterns described above. The surface of the workpiece will have areas, or bands, in which the scratches have a positive slope, and areas where the scratches have a negative slope, relative to a reference line. The band of scratches having a positive slope is produced when the roller oscillates away from the reference line. The band of scratches having a negative slope is produced when the roller oscillates toward the reference line. Thus, these bands of scratches alternate during the oscillatory motion of the abrasive roller.

Depending on the position of the light source and other factors, the bands of scratches that have a negative slope tend to reflect light in the direction of the reference line, and appear to an observer on the reference line to be light bands.

The bands of scratches that have a positive slope tend to reflect light away from the direction of the reference line, and appear to an observer on the reference line to be dark bands. These alternating light and dark bands are optical chatter marks, as described previously, and thus the present inventors believe that optical chatter is caused by axial roller oscillations.

The foregoing explanation of the cause of optical chatter marks was verified by measuring the axial roller oscillation of the finishing apparatus, finishing a workpiece with the apparatus, measuring the scratch pattern on the workpiece, and comparing the oscillation and scratch pattern measurements to the optical chatter marks observed on the workpiece. The testing procedure used to verify the theory was as follows.

A linear variable displacement transformer (LVDT) was used to measure the axial oscillation of the abrading roller of an abrasive finishing machine during operation. The LVDT was of the type available from Lucas Control Systems Products of Pennsauken, N.J., under the designation Model Number LBB-375PA-100. The LVDT was positioned so that its moveable core was in contact with the center of the rotating machine shaft carrying an abrasive roller. The outer, fixed housing of the LVDT was secured to the frame of the finishing machine. Thus, any axial movement of the machine shaft relative to the frame of the machine caused movement of the moveable core relative to the LVDT housing. Movement of the LVDT core causes the LVDT to generate a voltage having a magnitude directly related to the shaft position. In the configuration described above, the LVDT measured the shaft position to a precision of 0.00013 millimeters (0.000005 inches).

The output of the LVDT is a continuous, variable voltage. For proper operation of the LVDT, an accurate reference voltage must be supplied to the LVDT, which was done by coupling a signal conditioner to the LVDT. The signal conditioner was of the type available from Lucas Control Systems Products under the designation Model Number ATA 101. The signal conditioner also allows selection of the most suitable scale for the display of the voltage measurements that correspond to the axial shaft motion. The signal conditioner output was fed into a computer running software entitled Wavepack Package (version 2.40) and Master Trend (version 3.02), both of which are available from Computational Systems Incorporated (CSI) of Knoxville, Tenn., to produce a visual display of the axial shaft motion.

The finishing machine was of the type available from Timesavers, Inc. of Minneapolis, Minn. under the designation 50 inch Speed Buffer. A cleaning brush of the type available from the Minnesota Mining and Manufacturing Company of St. Paul, Minn., under the designation 7A Medium Cutting and Polishing Cleaning Brush was used with the finishing machine as an abrasive roller. The powered roller exhibited only slightly more than 0.0254 millimeters (0.001 inches) displacement in both axial directions from the center position.

The LVDT measured transverse displacement of the roller as the roller was rotated about its central axis. The term "transverse" is relative to the machine direction, which is the direction in which the workpiece is fed through the finishing machine. The software programs produced the graph displayed in FIG. 3, which plots the transverse displacement of the roller as a function of the number of roller rotations. The entire graph represents two complete rotations of the roller about its central axis, and the cyclical nature of the transverse displacement is evident in that the graph from 1.0 rotation to 2.0 rotations closely matches the graph from 0.0 rotations to 1.0 rotation.

After measuring and recording the transverse oscillatory motion of the roller shaft as described above with reference to FIG. 3, a sample workpiece was fed through the finishing machine. The workpiece was a piece of sheet aluminum 30.5 centimeters (12.0 inches) wide, 61.0 centimeters (24.0 inches) long, and 0.16 centimeters (0.0625 inches) thick. Care was taken to minimize any scratching of the sample surface prior to feeding it through the finishing machine. Sufficient pressure was applied by the abrasive roller to the workpiece to produce a uniform, thorough scratching of the workpiece. The abrasive roller was driven at 600 rotations per minute, and the workpiece was fed through the finishing machine at a rate of 0.37 meters per second (72 feet per minute). The rotational speed of the abrasive roller and the part feed rate were selected so that 3.8 centimeters (1.5 inches) of the workpiece would traverse the machine with each rotation of the abrasive roller. Because the production of chatter marks is directly related to the rotational velocity of the abrasive roller, these operating parameters resulted in the production of a full cycle chatter pattern for each 3.8 centimeters (1.5 inches) of the workpiece length.

The overall shape characteristics of the scratch pattern were measured, as follows. A series of photomicrographs of a portion of the workpiece surface measuring 0.038 centimeters (0.015 inches) by 4.32 centimeters (1.7 inches) were taken along the longitudinal, or feed direction of the workpiece, under approximately 180 power magnification. The individual photomicrographs were then secured end-to-end to a rigid surface, to create a magnified visual representation of the surface of the workpiece. Care was taken to insure that adjacent photomicrographs were correctly aligned, so that the scratches along the length of the photomicrographs accurately represented the workpiece surface. The actual size of the assembled photomicrographs was about 7.6 centimeters (3.0 inches) wide and 6.1 meters (20 feet) long. A reference line was established by securely mounting an bar along the aligned photomicrographs, to provide a basis for measuring the departure of the scratches from the reference line.

The individual scratches formed in the surface of the workpiece, as seen in the mounted photomicrographs, each ranged in length from approximately 13.2 centimeters (5.0 inches) to approximately 25.4 centimeters (10.0 inches). To provide a graphical representation of the characteristics of the overall scratch pattern, the characteristics of numerous individual scratches along the length of the workpiece were measured and combined, as follows. A scratch was selected near the beginning of the series of photomicrographs, and the distance between a point on that scratch and the reference line was measured and recorded. A micrometer was used for this measurement, which permitted a measurement accuracy of about 0.0076 centimeters (0.003 inches). Because the photomicrographs are a 180 power magnification of the workpiece, an accuracy of within 0.0076 centimeters (0.003 inches) on the photomicrographs represents an accuracy of within $5.08\times10^{-5}$ centimeters (0.00002 inches) on the actual workpiece. Succeeding measurements were made at 5.1 centimeter (2.0 inch) intervals along the length of the aligned photomicrographs. Because the photomicrographs are a 180 power magnification of the workpiece, the effective measurement interval is approximately every 0.0381 centimeters (0.015 inches) on the sample.

When the end of the first scratch was reached, a second scratch was selected for measurement. The second scratch in all cases began before the first scratch ended, but was either closer to or more distant from the reference line than was the previous scratch. The second scratch was "normalized" with respect to the first scratch, such that the vertical difference by which the end of the first scratch and the beginning of the second scratch were separated was ignored. That is, if the beginning of the second scratch was more distant from the reference line than was the end of the first scratch, the difference was subtracted from each subsequent measurement along the second scratch. Similarly, if the beginning of the second scratch was less distant from the reference line than was the end of the first scratch, the difference was added to each subsequent measurement along the second scratch. The foregoing measurement, normalizing, and recording procedure was repeated for at 5.1 centimeter (2.0 inch) intervals along the entire length of the photomicrographs. The effect of the normalizing procedure was to produce a set of measurements representing a single, composite scratch that extended along the length of the photomicrographs.

Figure 4:
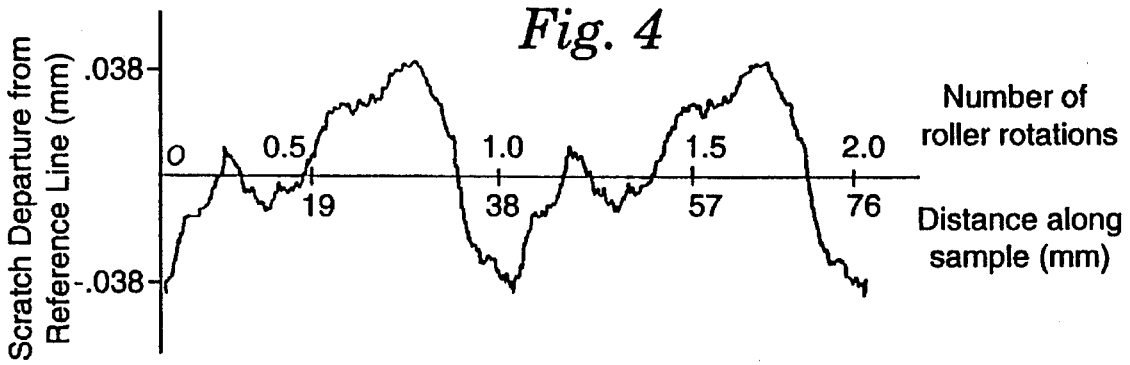
FIG. 4 is a graph corresponding to the graph of FIG. 3, showing the shape of the scratch pattern that makes up the chatter marks as a function of the feed distance of the workpiece.

The foregoing information was graphed in an initial data curve, with the horizontal axis representing the distance along the photomicrographs, and the vertical axis representing the distance between a point on the scratch and the reference line. To remove any effect due to the reference line being inadvertently inclined relative to the photomicrographs, a least squares linear regression line of the curve was calculated, and the regression line was subtracted from the initial data curve to provide a final data curve. A portion of the final data curve representing the distance along the workpiece corresponding to one rotation of the abrasive roller is shown in FIG. 4. The horizontal axis is given in terms of the number of rotations of the roller, and in terms of the feed distance (in millimeters) along the sample workpiece. The vertical axis is the normalized distance between each point on a scratch and the reference line. The portion of the final data curve that is shown from 0.0 rotations to 1.0 rotation is repeated between 1.0 rotation and 2.0 rotations.

FIG. 4 is a graphical representation of the composite scratch measurements obtained as described above. The portions of the curve that have a positive slope represent individual scratches that had a positive slope relative to the reference line. Portions of the curve having a negative slope represent individual scratches that had a negative slope relative to the reference line. It should be noted that the scale for the vertical axis is magnified by 250 times relative to the scale for the horizontal axis, to permit easier perception of the oscillatory nature of the scratch pattern.

Figure 3:
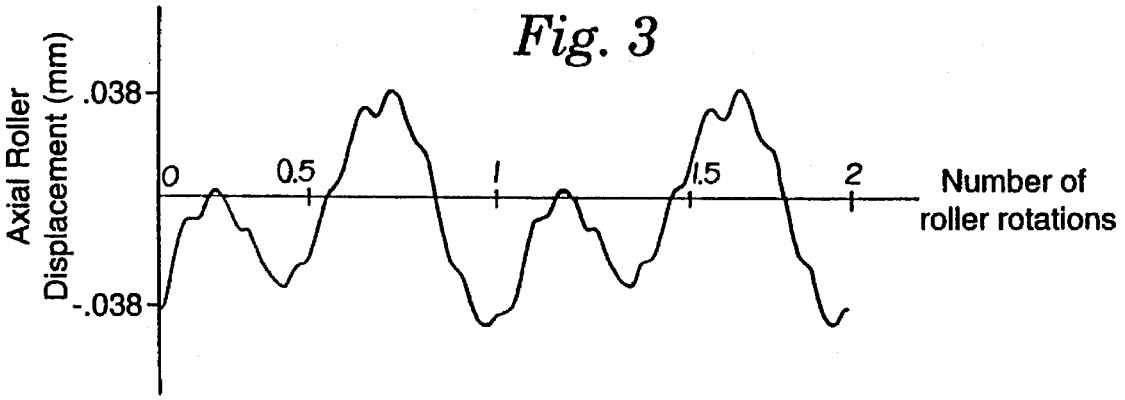
FIG. 3 is a graph of the axial position of a shaft of a powered roller of the finishing machine as a function of the rotational position of the shaft.

FIGS. 3 and 4 may be compared by aligning the respective vertical axes. It should be noted that the graphing scales used for FIGS. 3 and 4 magnify the axial motion of the shaft in FIG. 3, and the scratch position in FIG. 4, by a factor of 250 times for comparative purposes. The comparison shows that there is a very strong correlation between the axial roller motion graphed in FIG. 3 and the composite scratch characteristics graphed in FIG. 4.

Figure 5:
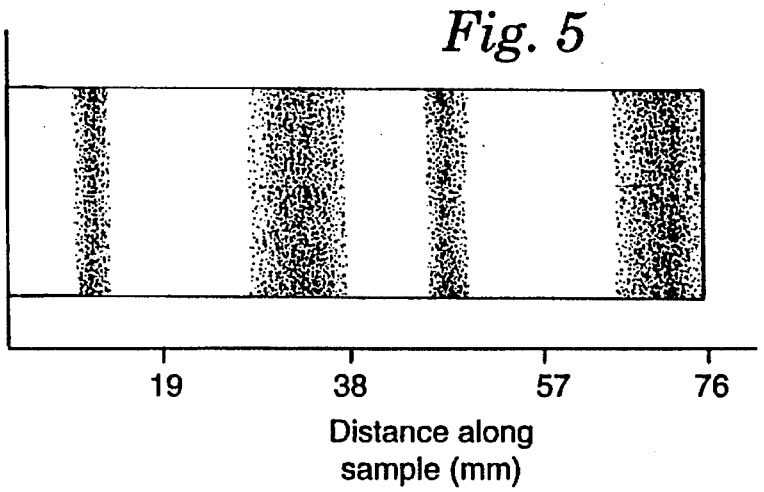
FIG. 5 is a graph of the optical chatter marks produced by the scratch pattern of FIG. 4, as produced by the axial shaft motion displayed in FIG. 3.

FIG. 5 is a representation of the finished surface of the workpiece, and is scaled to match the scale of FIGS. 3 and 4. Thus, the length of the workpiece along the horizontal axis was the length of the sample workpiece that was fed through the finishing machine during two rotations of the abrasive roller. Thus, the visible surface characteristics displayed in FIG. 5 may be compared to the scratch characteristics plotted in FIG. 4, and to the shaft displacement data plotted in FIG. 3. The workpiece shown in FIG. 5 displays the visible alternating dark bands and light bands that are characteristic of optical chatter. The dark bands are present in those areas where the slope of the curves in FIGS. 3 and 4 is negative. The light bands are present in those areas where the slope of the curves in FIGS. 3 and 4 is positive. There is strong correlation between the optical chatter marks on the finished workpiece and both the scratch direction and the axial shaft motion. Thus, the present theory of optical chatter being produced by axial shaft oscillations, rather than by vertical roller oscillations, has been substantiated.

Figure 6:
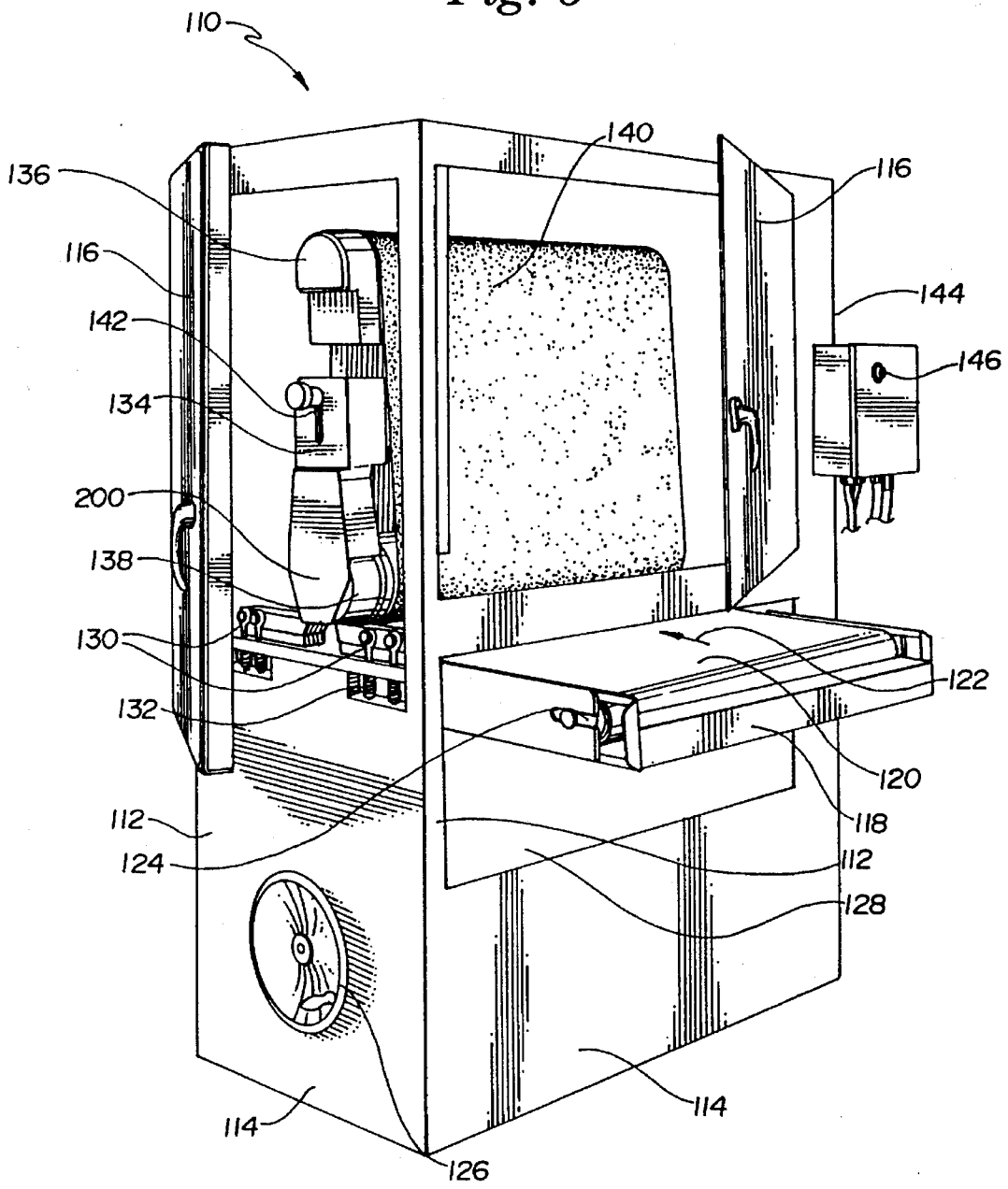
FIG. 6 is a perspective view of a finishing machine that has been modified to include the present invention.

Having identified the true cause of optical chatter as described above, the present invention is directed to a method and apparatus for attenuating optical chatter marks on a workpiece. FIG. 6 shows a finishing machine 110 that may be modified to incorporate the apparatus of the present invention. Finishing machine 110 is formed of frame members 112 that are preferably constructed of steel. Panel members 114 are carried between frame members 112 to enclose the working area of finishing machine 110 at least partially, and to reduce the noise produced by the finishing operation. Access doors 116, shown in the open position, permit access to the major operating components of finishing machine 110. For safety reasons, access doors 116 are typically closed during finishing operations.

A feed table 118 is provided on which to feed the workpiece into finishing machine 110, and includes a conveyor 120 that moves in the direction of arrow 122. Conveyor 120 is powered by a motor (not shown) contained within finishing machine 110. Conveyor 120 rides on a first unpowered roller 124 and is driven by a second powered roller (not shown) that is operatively connected to the motor.

Feed table 118 can be raised and lowered to accommodate workpieces of varying heights. In the illustrated embodiment, the table may be adjusted by hand crank 126, which is connected to feed table 118 by a jacking device (not shown) that is contained within finishing machine 110. An operator may raise or lower the feed table by rotating hand crank 126 in the appropriate direction. Suitable cutouts 128 formed on the front and the rear of panel members 114 accommodate the raising and lowering of feed table 118.

Pinch rollers 130 are mounted above conveyor 120. Pinch rollers 130 are spring loaded by springs 132 and biased in the downward direction. Pinch rollers 130 engage the upper side of the workpiece that is being finished to ensure that the workpiece is pressed against conveyor 120, so that the workpiece is fed through finishing machine 110.

Finishing head 134 has an upper idler roller 136 and a lower powered roller 138, over which an endless abrasive belt 140 is entrained. Upper idler roller 136 preferably has a smooth surface to facilitate the passage of abrasive belt 140 over idler roller 136 with a minimum amount of friction. In contrast, powered roller 138 is preferably larger in diameter than idler roller 136 to ensure adequate frictional contact with belt 140. Powered roller 138 typically has elastomeric exterior surface that frictionally contacts and engages belt 140 for rotation therewith. Powered roller 138 is typically machined and balanced to ensure that belt 140 contacts the workpiece as uniformly as possible.

Abrasive belt 140 may be any suitable belt, such as a coated abrasive belt. Numerous types of abrasive media and grits are available to provide one of a wide variety of finishes for application to the workpiece. For example, grain or satin finishes can be imposed on the surface of the finished product, or the belts can be used to finish flat parts that have burrs resulting from stamping, boring, and shearing operations.

Belt 140 is preferably automatically tensioned by tensioner 142, which may be a pneumatic device. Tensioner 142 adjusts the spacing between upper idler roller 136 and lower powered roller 138 to maintain the desired tension of belt 140. An additional adjustment available to ensure the uniform running of belt 140 is tracking adjuster 144. Tracking adjuster 144 is rotatable and is engaged with a cam (not shown). Rotation of tracking adjuster 144 causes the cam to raise and lower an end of idler roller 136, to enable belt 140 to run substantially centered on idler roller 136 and powered roller 138. A power control 146 is available to the operator to facilitate starting and stopping finishing machine 110.

In an alternative embodiment of finishing machine 110, the powered roller 138 has a replaceable abrasive sleeve disposed on the peripheral surface of the powered roller. In such an embodiment, upper idler roller 136 and belt 140 may be eliminated. The workpiece is finished by the abrasive medium that forms the outer peripheral surface of the abrasive sleeve. In other embodiments, powered roller 138 may be a bonded abrasive wheel, or may have an abrasive medium bonded directly to the peripheral surface of the roller.

Powered roller 138 is driven by an electric motor (not shown) that may be connected to powered roller 138 by a drive system, either directly, through a gear set, or by a pulley and belt system. The present inventors have determined that it is important that the motor and the drive system be properly aligned, because a slight misalignment between the motor and the drive system can tend to cause axial movement of powered roller 138, resulting in the formation of optical chatter marks on the finished piece. However, because of the inventive apparatus, the typical difficulty and expense inherent in attempting to provide perfectly aligned system components can be avoided, and thus the components need only be aligned as well as is reasonably possible.

The apparatus of the present invention includes an axial oscillation inducing device that is coupled to the shaft on which the roller is carried, which device produces high frequency axial oscillations in the powered roller 138. The high frequency axial oscillations cause the roller to impose high frequency chatter marks on the finished piece. The high frequency chatter marks (i.e. alternating light bands and dark bands) are so closely spaced that an observer does not perceive any optical chatter at all. Thus, the optical chatter typically present in the workpiece has been attenuated, resulting in a workpiece surface that is more aesthetically acceptable.

Figure 7:
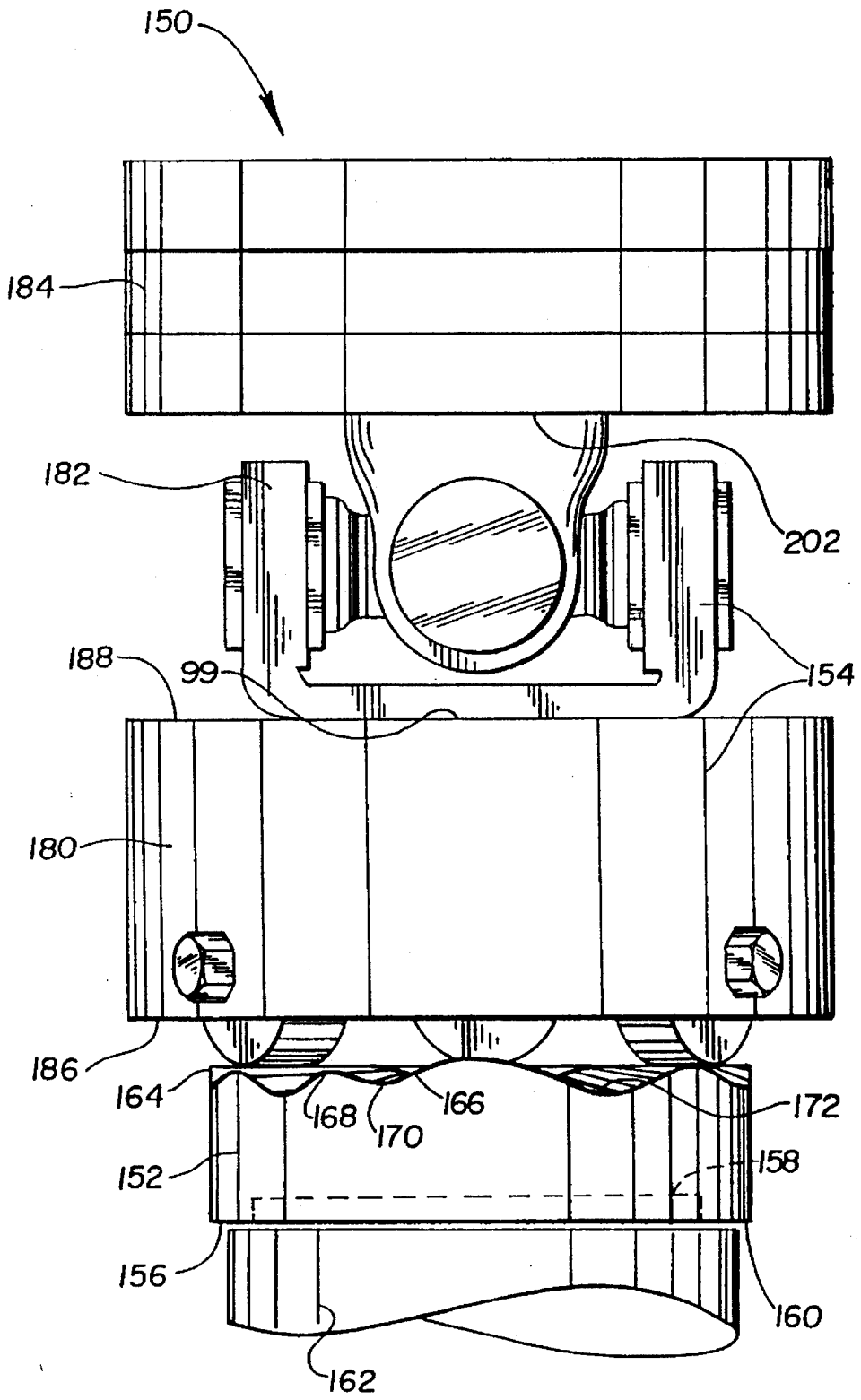
FIG. 7 is a front view of the oscillator made in accordance with the present invention.

In the illustrated embodiment, the high frequency oscillation device includes a nine lobed cam, which imparts nine axial cycles to the shaft for each rotation of the shaft. The axial oscillator 150 is depicted in FIG. 7, and has a rotating portion 152 and a non-rotating portion 154. The rotating portion 152 is preferably a high grade steel disc. A first side 156 of the rotating portion 152 includes a central circular cavity 158 defined by an outwardly directed circular lip 160. Cavity 158 and lip 160 act together to mate with the axial shaft 162 of powered roller 138. Rotating portion 152 and shaft 162 are held in fixed engagement, such that rotation of shaft 162 causes rotating portion 152 to rotate.

Second side 164 of rotating portion 152 has a circular face and is opposed to first side 156. Second side 164 includes a cammed race 166 proximate the outer periphery of second side 164. Cammed race 166 appears as an undulating ribbon, which is magnified in FIG. 4 for clarity. In fact, the undulations are on the order of 0.0254 to 0.127 millimeters (0.001 to 0.005 inches) from a valley to a peak of an undulation. Because the outer diameter of the cammed race 166 is greater than the inner diameter of cammed race 166, a trace of the top of a peak and a trace of the bottom of a valley each define a segment of a radius of the circular face of second side 164. Accordingly, the distance between two adjacent peaks measured at the outside diameter of cammed race 166 is greater than the distance between the two peaks measured at the inner diameter of the cammed race 166.

In a preferred embodiment, there are a total of nine peaks 170 and nine valleys 172 in the cammed race 166. This means that there are nine axial oscillations induced in the powered roller 138 for each rotation. The ratio of oscillations to rotations can be higher or lower than 9:1, as long as the oscillations occur at a sufficiently high frequency as compared to the frequency of rotation of the powered roller 138 that the optical chatter marks are masked. For example, ratios from 5:1 to 25:1 may satisfactorily produce the necessary high frequency oscillations to mask the chatter marks that result from a rotation of powered roller 138. The required oscillatory rate, and ratio, depends on the feed rate and the finishing machine characteristics, because those factors most heavily influence the optical chatter marks that would ordinarily be formed.

Figure 8:
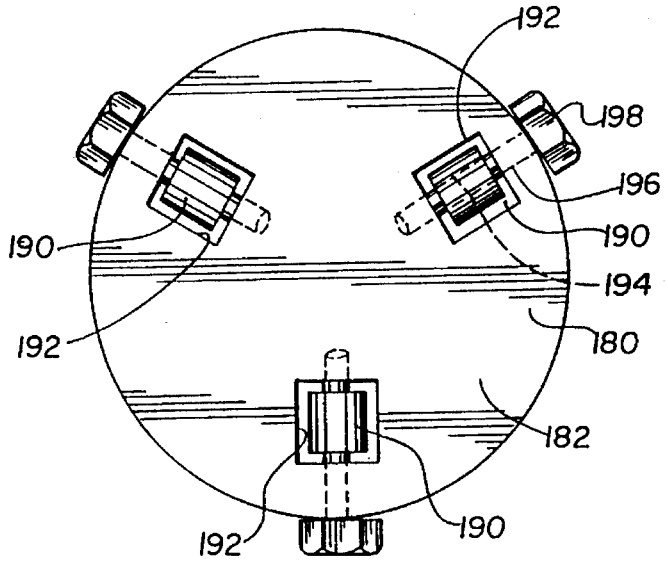
FIG. 8 is a front view of the cam driver of the oscillating apparatus.

The non-rotating portion 154 of axial oscillator 150 comprises a cam driver 180, a universal joint 182, and a mounting plate 184. Cam driver 180 is a solid metallic cylinder that is preferably made of high grade steel, and has a first and a second opposed faces 186 and 188. First face 186 is mounted spaced apart from and adjacent the cammed race 166 of rotating portion 152. Cam driver rollers 190 are disposed in first face 186 and are in rotational contact with cammed race 166. Cam driver rollers 190 are depicted in FIG. 8. Each of the cam driver rollers 190 should be disposed on a like segment of the cammed race 166 at all times during rotation, to ensure that the motion imparted to shaft 162 is purely axial and does not tend to impart a wobbling motion to shaft 162. Thus each of the rollers 190 should be on a peak of an undulation of cammed race 166 simultaneously. To ensure this, the cam driver rollers 190 should be equiangularly spaced about cam follower 180, and there should be a number of undulations of the cammed race 166 that is a multiple of the number of the cam driver rollers 190. Accordingly, in a preferred embodiment, there are three cam driver rollers 190 and, as previously indicated, there are nine undulations in cammed race 166. Other combinations of the number of race undulations and the number of cam driver rollers are also possible.

The cam driver rollers 190 are disposed in recesses 192 formed in first face 186 of cam driver 180. Recesses 192 are sized such that cam driver rollers 190 are able to rotate freely therein. In a preferred embodiment, cam driver rollers 190 have an axial bore 194 therethrough. When cam driver rollers 190 are disposed in recesses 192, the longitudinal axis of the axial bore 194 is aligned with a radial projection from the center of first face 186 of cam driver 180.

The axial bore 194 is aligned with a radial bore 196 formed in cam driver 180. Radial bore 196 is formed through the center of recess 192 and the innermost portion of the radial bore 196 is threaded. A bolt 198 is passed first through radial bore 196 and then through axial bore 194 of cam driver roller 190. Bolt 198 is then threaded into the threaded portion of axial bore 194. Bolt 198 is in rotational engagement with axial bore 194 of cam driver roller 190 and functions as an axle about which cam driver roller 190 is free to rotate.

The second face 188 of cam driver 180 is rigidly joined (e.g. by welding) to first end 99 of universal joint 182. The universal joint 182 ensures that the cam driver rollers 190 remain in contact with cammed race 166. The second end 202 of universal joint 182 is rigidly affixed (e.g. by welding) to mounting plate 184. The universal joint 182 in the prototype oscillating device 150 prevents any misalignment between the cam driver 180 and the cam surface 166 from causing unequal loading of the rollers 190 on the cam surface 166. However, the universal joint 182 may not be required in an axial oscillator 150 that is built to sufficiently fine tolerances, and thus is optional. The second face 188 of cam driver 180 is affixed directly to mounting plate 184. Mounting plate 184 ensures that the cam driver 180 is rigidly mounted to the frame members 200 of finishing machine 110. In a preferred embodiment, mounting plate 184 is a flat metallic plate that is affixed to the frame 200 of finishing machine 110 by bolts or by weldments.

Figure 9:
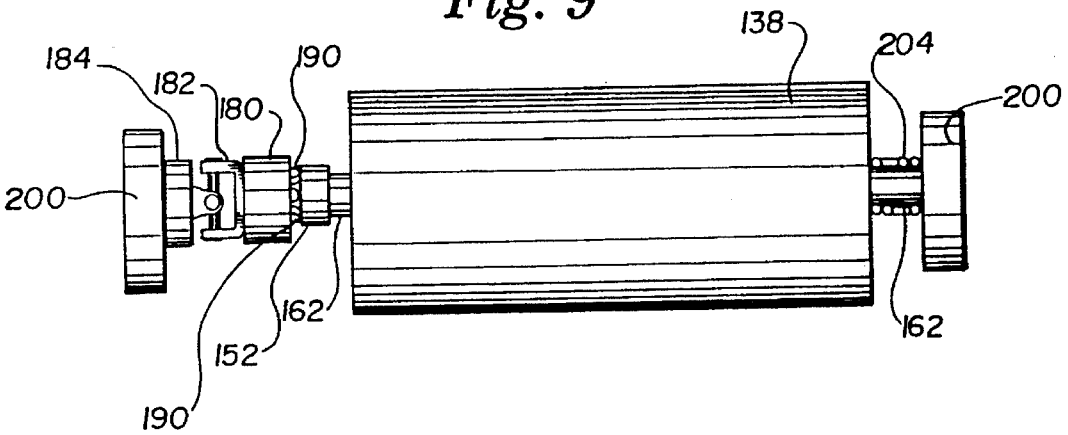
FIG. 9 is a front view of the powered roller with the oscillating apparatus attached.

FIG. 9 shows the present invention installed on a powered roller 138. A spring 204 is disposed around shaft 162 between the right end of powered roller 138 and frame 200. Spring 204 biases powered roller 138 to the left as viewed, to urge cammed race 166 into contact with cam driver rollers 190. In a preferred embodiment, spring 204 exerts a biasing force of approximately 300 pounds, but an appropriate biasing forces may be selected based on the oscillation frequency, oscillation amplitude, and mass of the rotor. A range of biasing forces between 200 and 600 pounds is believed to be preferable.

Axial oscillator 150 moves the powered roller 138 through nine axial oscillations with each rotation of the roller. The intended amplitude of the forced oscillation may be on the order of approximately 0.127 millimeters (0.005 inches), although the actual oscillation amplitude may be less due to damping effects. This limited axial motion, however, was adequate to significantly reduce the optical chatter marks.

The method and apparatus of the present invention are further described in the context of the following Examples.

EXAMPLES

A finishing machine was provided, including the oscillation inducing apparatus characteristic of the present invention. The apparatus could be disengaged from the abrasive roller of the finishing machine, so that there were no added axial oscillatory effects, or engaged with the roller to produce the high frequency axial oscillations according to the present invention. In a Comparative Example, a workpiece was finished using the finishing machine with the axial oscillator disengaged. In Example One, an identical workpiece was finished using the finishing machine with the axial oscillator engaged. The two workpieces were then compared.

Testing Apparatus: The workpiece used for each Example was a sheet of aluminum measuring 10.2 centimeters (4.0 inches) wide by 61.0 centimeters (24.0 inches) long by 1.52 millimeters (0.0625 inches) thick. The surface of the workpieces had a mill-run, "as received" finish.

The finishing machine used for the Examples was a "50 inch Speed Buffer" of the type available from Timesavers, Incorporated of Minneapolis, Minn. The rollers used were of the type available from Minnesota Mining and Manufacturing Company of St. Paul, Minn. under the designation 7A Medium Cutting and Polishing Cleaning Brush, with a diameter of approximately 27.94 centimeters (11.0 inches) and a length of approximately 127 centimeters (50 inches). Because the sample workpieces had a width of 10.16 centimeters (4.0 inches), only 10.16 centimeters (4.0 inches) of the length of the roller was in contact with the sample at any time.

The speed of the abrasive roller was 600 revolutions per minute, and the feed rate of the workpieces past the roller was 0.254 meters per second (50 feet per minute). The workpiece was passed through the finishing machine, and the force with which the roller contacts the sample was adjusted such that the roller contacted the sample uniformly across the width of the sample.

For use with Example One, the finishing machine was equipped with an engageable oscillation inducing apparatus in accordance with the present invention, of the type generally illustrated in FIG. 9 and described above. The nine-lobe cam had a cam amplitude of 0.127 millimeters (0.005 inches), causing the roller to axially oscillate 9 times for each rotation of the roller, with an amplitude of 0.127 millimeters (0.005 inches). The actual oscillation amplitude was less, due to the damping effects of the finishing machine itself. Because the rotational velocity of the abrasive roller was 600 rotations per second, the roller axially oscillated at a frequency of 5400 cycles per minute.

Comparative Example: A sample workpiece was fed through the finishing apparatus described above, with the axial oscillator disengaged, to finish the surface of the workpiece. The sample workpiece was manually fed through a set of pinch rollers, which drove the workpiece past the abrasive roller. The powered abrasive roller moved against the feed direction of the workpiece.

The workpiece surface exhibited alternating light and dark bands transverse to the feed direction of the workpiece, which is characteristic of optical chatter. The bands were approximately 1.3 centimeters (0.5 inches) wide, and the chatter marks were most easily perceived by viewing the workpiece at an angle of approximately 30° to the plane of the workpiece from a direction generally perpendicular to the scratch directions.

Example One: The axial oscillator was engaged on the finishing apparatus, and a second workpiece was manually fed through the finishing apparatus. Again, the Workpiece was fed through the pinch rollers, and the abrasive roller rotated against the feed direction of the workpiece.

The second workpiece exhibited a brushed satin finish consisting of numerous fine scratches in the feed direction of the workpiece. Optical chatter marks were visible, but at a greatly reduced intensity when compared to the Comparative Example workpiece. Thus, the method and apparatus of the present invention reduced the optical chatter marks associated with treating the surface of a workpiece with a conventional finishing machine.

The method and apparatus of the present invention exhibit many beneficial features and advantages. The rate at which material may be processed by an machine having the inventive apparatus installed is not adversely affected, and thus line speed is not sacrificed in exchange for an improved surface appearance. Additionally, the inventive apparatus for attenuating optical chatter marks is relatively inexpensive to produce, and may be installed on existing finishing machines with relative ease. This feature makes it economically feasible to retrofit existing finishing machines with the apparatus of the present invention to solve the problem of optical chatter. Also, the invention may easily be included as an improvement on future finishing machines.

The present invention has now been described with reference to several embodiments thereof. It will be apparent to those skilled in the art that many changes can be made in the embodiments described without departing from the scope of the invention. For example, the cammed race could be affixed to the machine frame, and the cam driver rollers could rotate with the shaft. Thus, the scope of the present invention should not be limited to the structures described herein, but rather by the structures described by the language of the claims, and the equivalents of those structures.

We claim:

1. An optical chatter reducing apparatus for use with a machine adapted to finish a surface of a workpiece by applying an abrasive media to the surface with a roller as the workpiece is advanced past the roller, the roller having a central axis and being powered to rotate about said axis, the apparatus comprising:

(a) an oscillation inducing apparatus operably coupled to said roller for inducing axial oscillations in the roller relative to the surface of the workpiece, wherein the frequency of the induced oscillations is greater than the frequency of rotation of the roller, and wherein the axial oscillations induced in the roller have an amplitude of between 0.025 and 0.127 millimeters and a spring to bias said roller along the central longitudinal axis of said roller to urge a cam driver means into contact with a cam race.

2. The optical chatter reducing apparatus of claim 1, further comprising said cam means including:

(a) a circular face disposed concentric with the central axis of the roller and oriented transverse thereto;

(b) said cam face defining a circular cammed surface on said face and being concentric with the central axis of the roller;

(c) said cam driver means in rotational contact with the cam race means for riding over the cammed surface during the rotation of the roller; and (d) a plurality of cam lobes formed in the surface of the cam race for inducing a plurality of axial oscillations in the roller during each rotation of said roller;

wherein one of the cam race and the cam driver means is operatively connected to the roller so as to rotate at the same rotational frequency as the surface of the roller.

3. The optical chatter reducing apparatus of claim 2, wherein there are between 5 and 25 cam lobes defined in the surface of the cam race.

4. The optical chatter reducing apparatus of claim 2, wherein the surface of the circular cam race is an undulating surface having alternating peaks and valleys, each of said peaks and valleys defining a radial segment of the circular face of the cam means.

5. The chatter reducing apparatus of claim 4, wherein the dimension of the cammed race from peak to valley is between 0.025 to 0.127 millimeters.

6. The optical chatter reducing apparatus of claim 2, wherein the cam driver comprises a number of rollers, and the number of cam lobes is a multiple of the number of rollers in the cam driver.

7. The optical chatter reducing apparatus of claim 2, further comprising a spring to bias the roller along the central longitudinal axis of the roller, to urge the cam driver means into contact with the cam race.

8. An apparatus for reducing optical chatter marks on a surface of a workpiece, in combination with a finishing machine having a roller for applying an abrasive media to a workpiece to be finished, the roller being powered and rotating about a central axis, the apparatus comprising oscillation means operably coupled to the roller for imparting axial oscillations to the roller relative to the workpiece during rotation of the roller, the oscillations being of sufficiently greater frequency than the frequency of rotation of the roller to mask the optical chatter marks, wherein the oscillations have an amplitude of between 0.025 to 0.127 millimeters and a spring to bias said roller along the central longitudinal axis of said roller to urge a cam driver means into contact with a cam race.

9. The apparatus of claim 8, further comprising said cam means including:

(a) a circular face disposed concentric with the central axis of the roller and oriented transverse thereto;

(b) said cam race defining a circular cammed surface on said face and being concentric with the central axis of the roller;

(c) said cam driver means in rotational contact with the cam race means for riding over the careened surface during the rotation of the roller; and (d) a plurality of cam lobes formed in the surface of the cam race for inducing a plurality of axial oscillations in the roller during each rotation of said roller;

wherein one of the cam race and the cam driver means is operatively connected to the roller so as to rotate at the same rotational frequency as the surface of the roller.

10. The apparatus of claim 9, wherein there are between 5 and 25 cam lobes formed in the surface of the cam race.

11. The apparatus of claim 10, wherein the surface of the circular cam race is an undulating surface having alternating peaks and valleys, each of said peaks and valleys defining a radial segment of the circular face of the cam means.

12. The apparatus of claim 11, wherein the vertical dimension of the cammed race from peak to valley is between 0.025 to 0.127 millimeters.

13. The apparatus of claim 10, wherein the cam driver means comprises a number of rollers, and the number of cam lobes is a multiple of the number of roller in the cam driver means.

14. The apparatus of claim 9, wherein the cam driver means and rollers.

15. A method for reducing optical chatter marks on a surface of a workpiece imparted to the surface by a finishing machine having a roller being rotationally driven and rotating on an axial shaft, the method comprising the steps of imparting axial oscillations to the roller during rotation of the roller, with a cam driver and cam race, and biasing said roller with a spring toward said cam race the oscillations being of greater frequency than the frequency of rotation of the roller, wherein the oscillations have an amplitude of between 0.025 and 0.0127 millimeters.

16. The method of claim 15, further including the step of imparting axial oscillations to the roller at 5 to 25 times the frequency of rotation of the roller.

* * * * *